US010938158B2

(12) United States Patent
Corriou et al.

(10) Patent No.: US 10,938,158 B2
(45) Date of Patent: Mar. 2, 2021

(54) CONNECTOR HOUSING, ADAPTER, AND MODULAR ELECTRICAL PLUG CONNECTOR SYSTEM COMPRISING THE SAME

(71) Applicant: Connecteurs Electriques Deutsch, Evreux (FR)

(72) Inventors: Thierry Corriou, Ecquevilly (FR); Jean-Luc Moreau, Evreux (FR)

(73) Assignee: Connecteurs Electriques Deutsch, Evreux (FR)

( * ) Notice: Subject to any disclaimer, the term of this patent is extended or adjusted under 35 U.S.C. 154(b) by 0 days.

(21) Appl. No.: 16/356,644

(22) Filed: Mar. 18, 2019

(65) Prior Publication Data

US 2019/0288449 A1 Sep. 19, 2019

(30) Foreign Application Priority Data

Mar. 16, 2018 (EP) ..... 18305292

(51) Int. Cl.

| | |
|---|---|
| ***H01R 27/02*** | (2006.01) |
| ***H01R 13/629*** | (2006.01) |
| ***H01R 13/504*** | (2006.01) |
| ***H01R 13/514*** | (2006.01) |
| ***H01R 13/518*** | (2006.01) |

(Continued)

(52) U.S. Cl.

CPC ..... *H01R 13/62927* (2013.01); *H01R 13/504* (2013.01); *H01R 13/514* (2013.01); *H01R 13/518* (2013.01); *H01R 13/639* (2013.01); *H01R 27/02* (2013.01); *H01R 33/90* (2013.01);

(Continued)

(58) Field of Classification Search

CPC .. H01R 13/62927; H01R 33/90; H01R 27/02; H01R 13/639; H01R 13/518; H01R 13/514; H01R 13/504; H01R 27/00; H01R 12/714; H01R 2201/26

See application file for complete search history.

(56) References Cited

U.S. PATENT DOCUMENTS 4,032,209 A 6/1977 Rutkowski
5,238,427 A * 8/1993 Fry ..... H01R 13/745 248/231.9

(Continued)

FOREIGN PATENT DOCUMENTS

DE 102013106279 A1 12/2014
DE 202015101799 U1 8/2016

(Continued)

OTHER PUBLICATIONS

European Search Report, dated Aug. 23, 2018, 8 pages.

(Continued)

*Primary Examiner* — Truc T Nguyen
(74) *Attorney, Agent, or Firm* — Barley Snyder

(57) ABSTRACT

A connector housing of a modular electrical plug connector system comprises a plurality of substantially identical passages arranged side by side. Each passage is configured to accommodate and lock an electrical connector module of a first predetermined type. At least one passage comprises an adapter receiving interface configured to receive, in a removable manner, an adapter for supporting and locking an electrical connector module of a second predetermined type, different from the first predetermined type.

19 Claims, 9 Drawing Sheets

(51) Int. Cl.

| | |
|---|---|
| ***H01R 13/639*** | (2006.01) |
| ***H01R 33/90*** | (2006.01) |
| *H01R 12/71* | (2011.01) |
| *H01R 27/00* | (2006.01) |

(52) U.S. Cl.
CPC ..... *H01R 12/714* (2013.01); *H01R 27/00* (2013.01); *H01R 2201/26* (2013.01)

(56) References Cited

U.S. PATENT DOCUMENTS

| | | | | |
|---|---|---|---|---|
| 5,562,493 | A * | 10/1996 | Ferrill | H01R 13/518 439/536 |
| 5,599,206 | A * | 2/1997 | Slack | H01R 24/64 439/536 |
| 5,647,043 | A * | 7/1997 | Anderson | G02B 6/3825 385/78 |
| 7,057,157 | B2 * | 6/2006 | Kimura | G01V 8/24 250/227.11 |
| 7,294,024 | B2 * | 11/2007 | Hammond, Jr. | H01R 13/6471 439/607.05 |
| 8,033,867 | B1 * | 10/2011 | Kessler | H01R 25/14 439/652 |
| 8,038,456 | B1 * | 10/2011 | Wang | G02B 6/3898 439/172 |
| 8,137,120 | B2 * | 3/2012 | Bortoli | H02B 1/56 439/115 |
| 8,270,796 | B2 * | 9/2012 | Nhep | G02B 6/3897 385/135 |
| 2008/0112672 | A1 * | 5/2008 | Lewallen | G02B 6/3825 385/58 |
| 2014/0045373 | A1 | 2/2014 | Kaesser | |
| 2016/0093980 | A1 | 3/2016 | Beischer et al. | |
| 2018/0248299 | A1 | 8/2018 | Wolffle | |

FOREIGN PATENT DOCUMENTS

| | | | |
|---|---|---|---|
| DE | 102015114814 | A1 | 3/2017 |
| WO | 2014139699 | A1 | 9/2014 |

OTHER PUBLICATIONS

Machine-generated Abstract of DE202015101799, dated Aug. 25, 2016, 1 page.
Abstract of WO2014139699, dated Sep. 18, 2014, 2 pages.

* cited by examiner

CONNECTOR HOUSING, ADAPTER, AND MODULAR ELECTRICAL PLUG CONNECTOR SYSTEM COMPRISING THE SAME

CROSS-REFERENCE TO RELATED APPLICATION

This application claims the benefit of the filing date under 35 U.S.C. § 119(a)-(d) of European Patent Application No. EP18305292.7, filed on Mar. 16, 2018.

FIELD OF THE INVENTION

The present invention relates to the field of modular electrical plug connector systems comprising a connector housing accommodating different types of plug-in connector modules.

BACKGROUND

Modular electrical plug connector systems typically comprise a connector housing, which can also be designated as "module rack" or "module mount", accommodating a plurality of plug-in connector modules. In these systems, the connector housing usually comprises fixed slots or passages designed to receive the plug-in connector modules in a predetermined arrangement, which can vary depending on the connectivity requirements of the application.

In some electrical connectivity applications, for instance in automotive or aeronautical applications, it is common to use configurations comprising different types of connector modules disposed in a same connector housing. For instance, one type of plug-in connector module, which can be designated as "standard module" hereafter, can comprise a plurality of (male or female) contacts configured for receiving a plurality of corresponding wire-like (female or male, respectively) crimp contacts, in particular, along an insertion direction corresponding to the direction along which the plug-in connector module is disposed in the connector housing. Furthermore, another type of plug-in connector module, which can be designated as "low profile (LP) module" hereafter, can comprise bent contacts configured to be soldered to a printed circuit board, in particular, along a direction substantially perpendicular to the direction along which the plug-in connector module is disposed in the connector housing.

In known modular electrical plug connector systems, different types of connector modules, in particular standard connector modules and low profile connector modules, typically have different shapes and dimensions. As a result the design and configuration of the slots or passages of the connector housing are usually fixed during the manufacturing process, according to the required configuration and particular arrangement of the plug-in connector modules.

Consequently, in known modular electrical plug connector systems, it is usually not possible to position a connector module of a given type, e.g. a standard module, in a slot or passage designed for a connector module of a different type, e.g. a low profile module, without redesigning at least part of the connector housing.

Accordingly, a drawback of known modular connector systems is that it is difficult to standardize the manufacturing process of the connector housing, in particular, in a manner that would be suitable for providing different configurations of connector modules without having to provide a different bottom plate of the connector housing for each configuration. This results in high manufacturing costs, especially for connectivity applications in harsh environments (i.e., environments submitted to intense vibrations, high temperatures, or the like), where at least the bottom plate (or front side) of the connector housing may need to be made of metal instead of a plastic material.

US 2014/0045373 A1 and WO 2014/139699 A1 disclose modular electrical plug connector assemblies for control units in motor vehicles, wherein an assembly comprises a module rack (module mount, or module carrier) and at least two different types of plug-in connector modules which can accommodate respective electrical plug connectors. The connector modules are arranged in respective specifically designed and dedicated slots or passages of a bottom plate (or front side) of the module rack and can only be positioned relative to each other in a predetermined manner. Moreover, the connector modules are inseparably connected to the module rack by a joining process (e.g., welding or gluing).

As a result, in these known modular electrical connector assemblies, the configuration of the connector modules in the module rack are determined during the manufacturing process. The end result is different configurations requiring different designs of the module rack, and in particular of the bottom plate (or front side) of the module rack.

In view of the above, it is desirable to provide an improved modular electrical plug connector system that would allow using different connector module configurations without having to redesign a new bottom plate of the connector housing for each configuration. It is also desirable to provide an improved connector housing that could be manufactured in a standardized manner and that could be used for different connector module configurations in a simple manner. In particular, it is desirable to provide an improved connector housing and corresponding modular electrical plug connector system, wherein a same slot or passage of the connector housing could be used for supporting and locking different types of connector modules.

SUMMARY

A connector housing of a modular electrical plug connector system comprises a plurality of substantially identical passages arranged side by side. Each passage is configured to accommodate and lock an electrical connector module of a first predetermined type. At least one passage comprises an adapter receiving interface configured to receive, in a removable manner, an adapter for supporting and locking an electrical connector module of a second predetermined type, different from the first predetermined type.

Thus, the present invention provides a modular connector housing with which it is possible to use more than one predetermined module in a plurality of different configurations without having to redesign a bottom plate of the connector housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
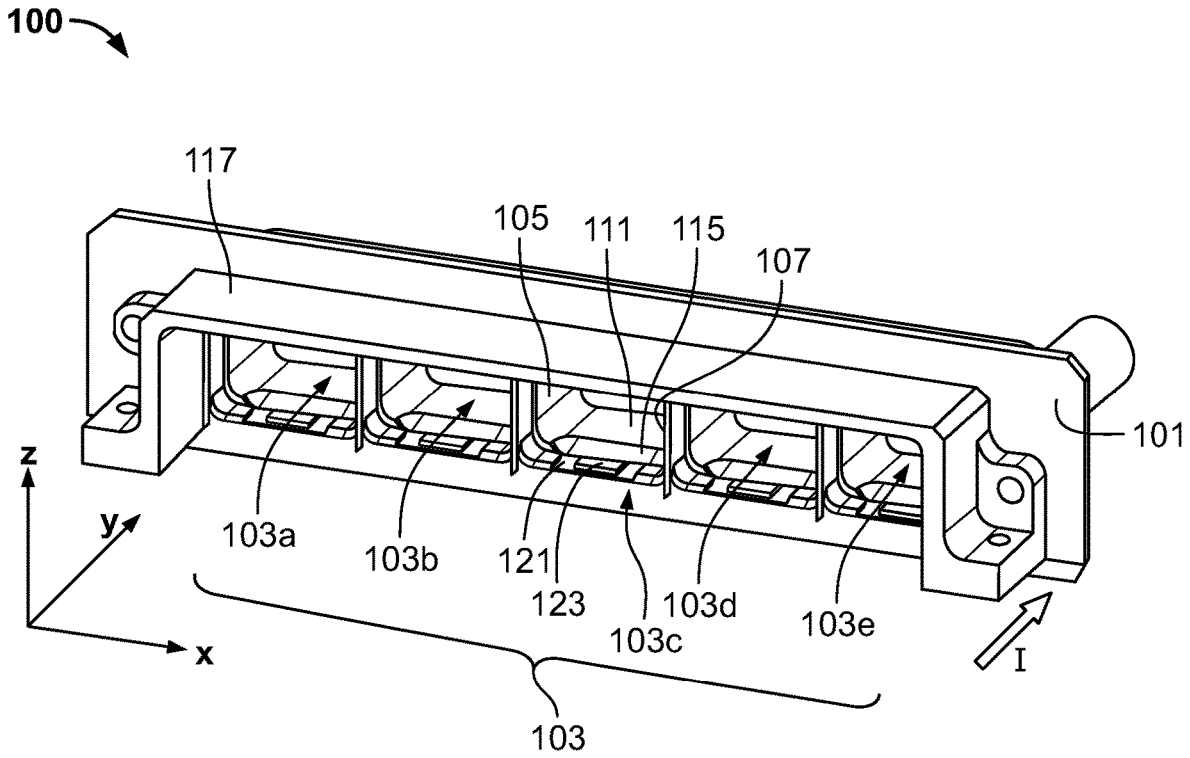
FIG. 1 is a perspective view of a connector housing according to an embodiment of the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An embodiment of the present invention will now be described with reference, in particular, to FIGS. 1 to 8.

Figure 2:
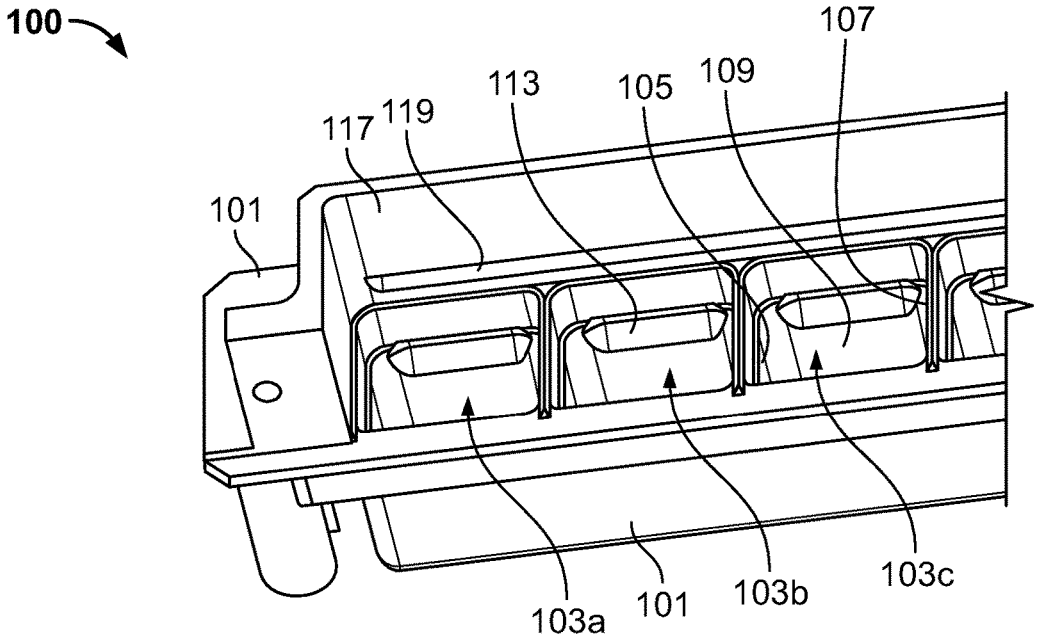
FIG. 2 is a perspective view of a portion of the connector housing of FIG. 1.

A connector housing 100 of a modular electrical plug connector system according to an embodiment of the invention is shown in FIGS. 1 and 2. In particular, FIG. 1 illustrates the connector housing 100 viewed from the top and front sides, and FIG. 2 illustrates the connector housing 100 viewed from the bottom and front sides. The connector housing 100 comprises a connector body 101, which is configured to receive, accommodate, and lock (in a removable manner), a plurality of plug-in connector modules of a first predetermined type. The connector housing 100 can accommodate and lock plug-in connector modules of the first predetermined type, and of a second predetermined type, different from the first predetermined type. However the second predetermined type would use an adapter or structural element, according to another aspect of the invention, to properly lock and support the second predetermined type within the connector housing 100.

The connector housing 100 is configured to accommodate and lock without any additional structural element "low profile" (LP) type connector modules such as the LP connector module 300 shown in FIGS. 6 and 7 and described below. In other embodiments, a connector housing could be adapted to accommodate a different type of plug-in connector module. Furthermore, as will also be described below, when the connector housing 100 is used in combination with a removable adapter such as the adapter 200 shown in FIGS. 3-5, the connector housing 100 can then accommodate and lock other types of modules, for example a standard module 400 shown in FIGS. 6 and 8.

Figure 6:
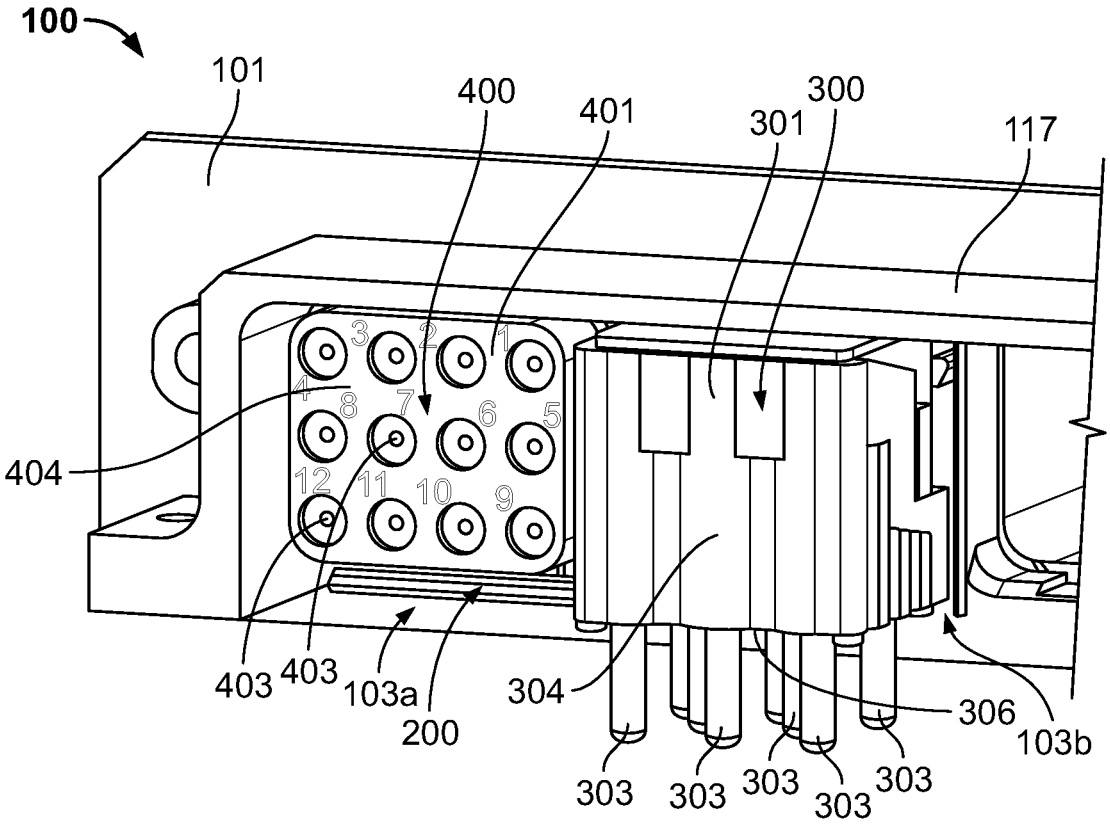
FIG. 6 is another perspective view of the modular electrical plug connector system of FIGS. 4 and 5.
Figure 7:
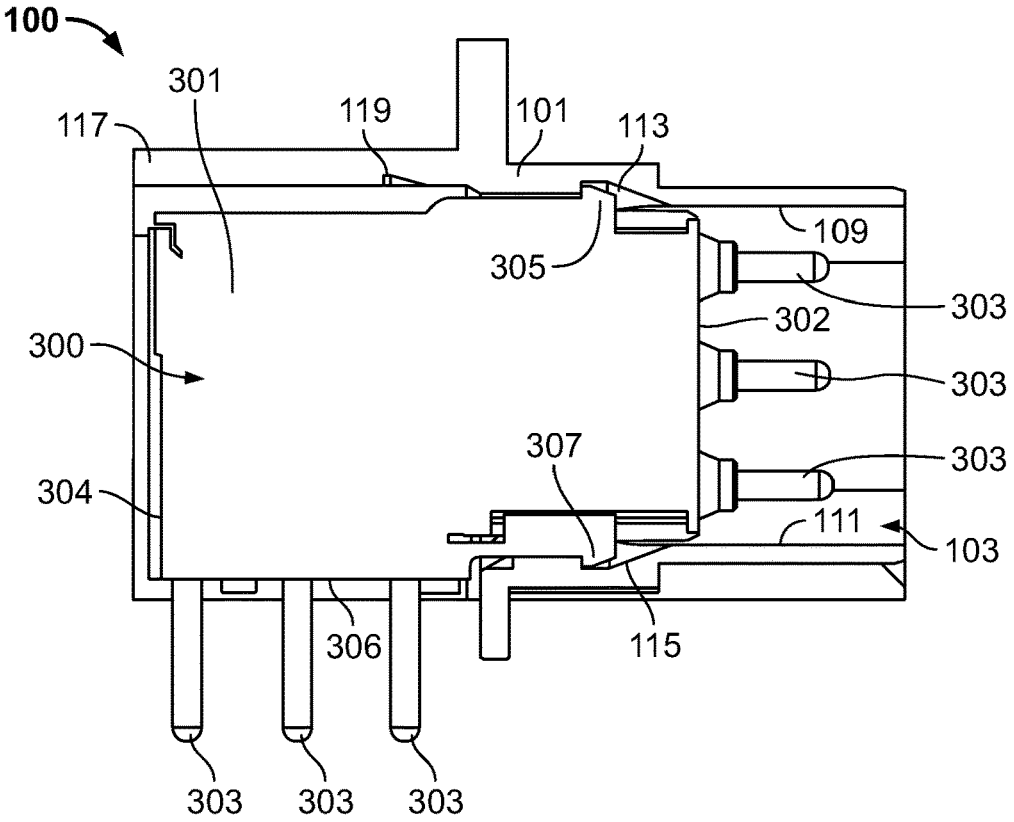
FIG. 7 is a cross-sectional side view of the modular electrical plug connector system of FIG. 6.

As shown in FIGS. 1 and 2, the connector body 101 of the connector housing 100 comprise a plurality of adjacent module receiving passages 103 (103*a*, 103*b*, 103*c*, 103*d*, 103*e*) arranged side by side and configured to accommodate a respective LP connector module 300 therein (see FIGS. 6 and 7). In other words, the shape and size of each module receiving passage 103 is adapted to accommodate and lock therein a corresponding LP connector module 300 without requiring an additional structural element such as an adapter. As shown, the connector housing 100 is represented with five module receiving passages 103*a*-103*e*. Accordingly, the connector housing 100 can accommodate up to five LP connector modules 300. However, one of skill in the art would appreciate in other embodiments a connector housing could comprise more or less that five passages and could accommodate more or less plug-in connector modules.

As shown in FIGS. 1 and 2, each module receiving passage 103 (103*a*-103*e*) can be provided as an opening in the front side of the connector body 101 so as to extend within the connector body 101 along an insertion direction (I) corresponding to the direction in which a plug-in connector module should be inserted in the connector housing 100. Furthermore, each module receiving passage 103 can comprise two sidewalls 105, 107, an upper wall 109, and a bottom wall 111. The upper wall 109 and the bottom wall 111 comprise a locking groove for engaging and locking a connector module of the first predetermined type. For instance, in each module receiving passage 103, the upper wall 109 and the bottom wall 111 both comprise a respective (upper or lower) LP module locking groove 113, 115 for engaging and locking a corresponding locking element, for instance a locking tab 305 or a locking lance 307 of an LP connector module 300, as shown in FIG. 7.

A general orientation of the connector housing 100 is shown in FIG. 1, wherein: X represents a first direction, which can be a width direction of the connector body 101; Y represents a second direction, which can be a depth direction of the connector body 101 corresponding to the insertion direction (I) (see FIG. 4) for inserting a plug-in connector module; and Z represents a third direction, which can be a height direction of the connector body 101. The same orientation will also be used in the other examples and embodiments described hereinafter and is illustrated, e.g., also in FIGS. 4, 9, and 16. Furthermore, since the connector housing 100 is configured to receive LP connector modules 300 by default, the bottom part of the connector housing 100 may be a part configured for being attached to a printed circuit board (PCB). Further embodiments of a connector housing described hereinafter may also be configured for attachment to a PCB.

Furthermore, as shown in FIGS. 1 and 2 the connector housing 100 can also comprise a front protruding portion 117, which can protrude from the front side of the connector body 101. For instance, the front protruding portion 117 can surround the module receiving passages 103*a*-103*e* on three sides (a left side, an upper side, and a right side in the orientation shown in FIG. 1), but not on a lower side of the connector body 101, so as to leave space for the downwards extending end of bent electrical contact 303 of a LP module 300 (when accommodated in a module receiving passage 103) to be connected to a PCB. The front protruding portion 117 of the connector housing 100 can be a separate element from the connector body 101, or it can be integrally formed, e.g. molded, with the connector body 101.

As described above, a first type of plug-in connector module that may be inserted in the connector housing 100 without using an adapter, could be a low profile (LP) module, an example of which is shown in FIGS. 6 and 7. As shown, a LP module 300 can comprise a module body 301 which can be substantially box-shaped, and bent electrical contacts 303. ALP module 300 is configurable for achieving electrical connectivity between connectivity elements in a substantially perpendicular manner. As shown in FIG. 7, at a backside 302 of the module body 301, the bent electrical contacts 303 can protrude lengthwise in prolongation of the module body 301 Furthermore, as shown in FIG. 6, at a front side 304 of the module body 301, the bent electrical contact 303 protrudes downwards from a lower part 306 of the module body 301, and as shown in FIG. 7, in a substantially perpendicular manner with respect to their configuration at the backside 302.

As described above, the LP module 300 also comprises a locking element such as the locking tab 305 and the locking lance 307 (or other known locking elements) shown in FIG. 7, which can engage the corresponding upper and lower LP module locking grooves 113, 115 in a corresponding module receiving passage 103 of the connector housing 100 so as to be locked therein.

Accordingly, in the orientation illustrated in FIG. 1, when the LP module 300 is accommodated in a module receiving passage 103 of the connector housing 100 as shown in FIGS. 6 and 7, the bent electrical contacts 303 protrude from the backside 302 of the module body 301 inside a respective module receiving passage 103 and towards the backside of the connector housing 100 along the depth direction Y corresponding also to the insertion direction (I) (see FIG. 7). In this way, at its backside 302, the LP module 300 could be connected, for instance, to a pluggable connector (not illustrated) comprising, in this case, female contacts mating the electrical contacts 303.

Furthermore, as shown in FIGS. 6 and 7, the connector body 101, in particular the module receiving passages 103, and more particularly the arrangement of the upper and lower LP module locking grooves 113, 115, are adapted so that the front side 304 of the module body 301 extends outside of the corresponding module receiving passage 103, whereby the bent electrical contacts 303 protrude from the lower part 306 of the front side 304 of the module body 301 downwards along the height direction Z. In this way, at the front side 304, the LP module 300 can be connected to a PCB, for instance by welding the electrical contacts 303 to corresponding contacts of the PCB (not illustrated).

Figure 8:
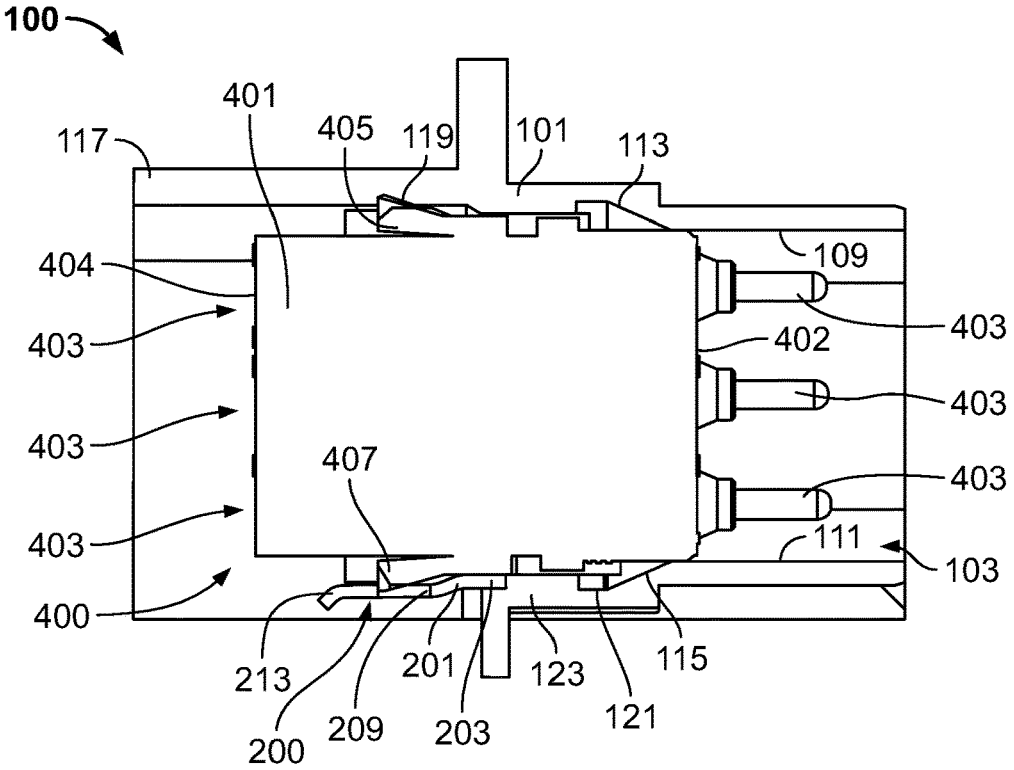
FIG. 8 is another cross-sectional side view of the modular electrical plug connector system of FIG. 6.

In the example embodiments, it is also desirable to accommodate and lock a plug-in connector module of a different type than the LP module 300 in the connector housing 100 in an interchangeable manner with the LP modules. In particular, as shown in FIGS. 6 and 8, it is desirable to provide a solution for accommodating a standard module such as the standard module 400. As shown, the standard module 400 can comprise a module body 401 which can be substantially box-shaped but, in particular, of smaller length (along direction Y) and of smaller height (along direction Z) than the LP module 300. The standard module 400 can comprise longitudinally extending electrical contacts 403 both at the backside 402 and the front side 404 of the module body 401, whereby a linear connection can be achieved between electrical connectivity elements plugged at each end of the standard module 400. In particular, the electrical contacts 403 of the standard module 400 can receive mating contacts of mating pluggable electrical connectors (not illustrated) on the backside 402 and/or on the front side 404 of the module body 401 along the insertion direction (I) (i.e., along the depth direction Y in the orientation shown in FIG. 1). In the shown embodiments, the electrical contacts 403 are represented as male electrical contacts, but it can be appreciated by one of ordinary skill in the art that this aspect is not limiting to the scope of the t invention. Thus, one of skill in the art can appreciate that in other embodiments, the electrical contacts 403 can be female electrical contacts without departing from the scope of the present invention.

In addition, the standard module 400 can comprise the locking element for locking the same within a module receiving passage of the connector housing of a modular electrical plug connector system. For instance, as shown in FIG. 8, the standard module 400 can comprise upper and lower locking tabs 405, 407 (or locking lances, or similar locking devices).

In order to prepare the connector housing 100 for accommodating and locking a standard module 400, the front protruding portion 117 can be provided at an inner surface with the locking element arranged and configured for engaging a corresponding (upper) locking element of a standard module 400. Accordingly, in the shown embodiments, the front protruding portion 117 can comprise an upper standard module locking groove 119, as shown in FIG. 2, which can be arranged and configured for engaging the upper locking tab 405 of a standard module 400, as will be described hereafter shown in FIG. 8.

Additionally, in order to prepare the connector housing 100 for accommodating and locking a standard module 400, the connector housing 100 comprises an adapter receiving interface which is arranged and configured to receive, in a removable manner, an adapter for supporting the standard module 400 in at least one of the module receiving passages 103 and, in combination with the upper standard module locking groove 119, locking the standard module 400 in a module receiving passage 103. As shown, in FIG. 1, for maximum modularity, a corresponding adapter receiving interface can be provided in each module receiving passage 103. As shown in example embodiments of FIGS. 1, 4, 5, and 8, each adapter receiving interface can be positioned preferably towards the front opening of a corresponding module receiving passage 103, here in particular, as an adapter receiving portion 121 which can be a recessed portion of the bottom wall 111 of the module receiving passage 103, and can further comprise an adapter locking tab 123.

Figure 3:
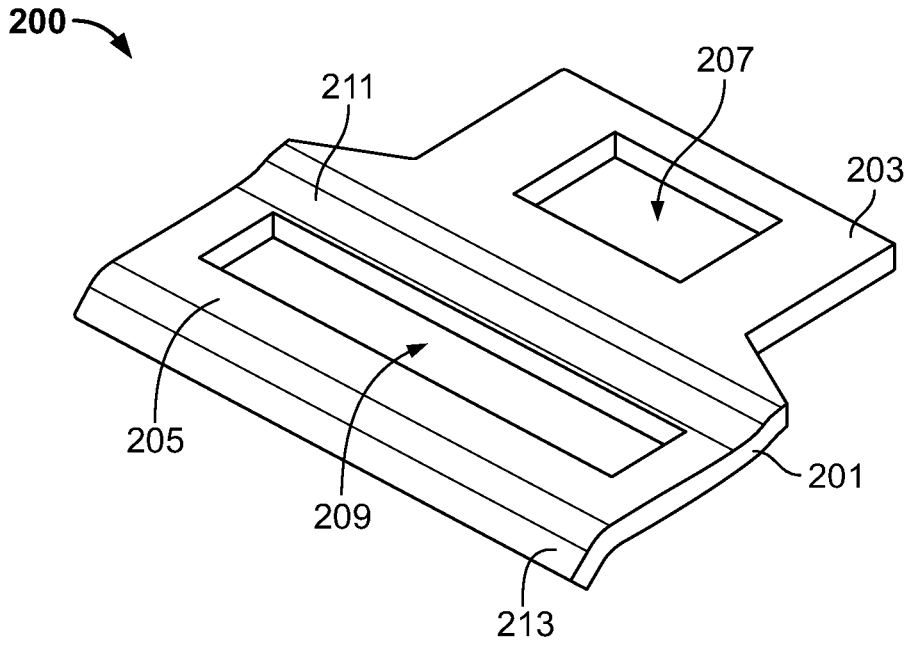
FIG. 3 is a perspective view of an adapter according to the invention.

FIG. 3 shows, according to an embodiment of the present invention, an adapter 200 for supporting and locking an electrical connector module in the connector housing of a modular electrical plug connector system. As further shown in FIGS. 4 and 5, the adapter 200 is configured, in particular, for engaging the adapter receiving portion 121 and adapter locking tab 123 of a module receiving passage 103 of the connector housing 100 of the embodiments described above.

Therefore, in these embodiments and as shown in FIG. 3, the adapter 200 comprises an adapter body 201 with a first end portion defining a connector interface engaging portion 203, which is a portion thereof arranged and configured for engaging the adapter receiving interface of a module receiving passage 103 of the connector housing 100. The adapter body 201, therefore comprises a second end portion defining a module supporting portion 205, which is a portion thereof arranged and configured for supporting and locking a standard module 400 when used in combination with the connector housing 100. In these embodiments, the connector interface engaging portion 203 and the module supporting portion 205 can extend essentially along the same direction, which can correspond to the insertion direction (I) (or the depth direction Y) when the adapter 200 is mounted in the connector housing 100.

Figure 4:
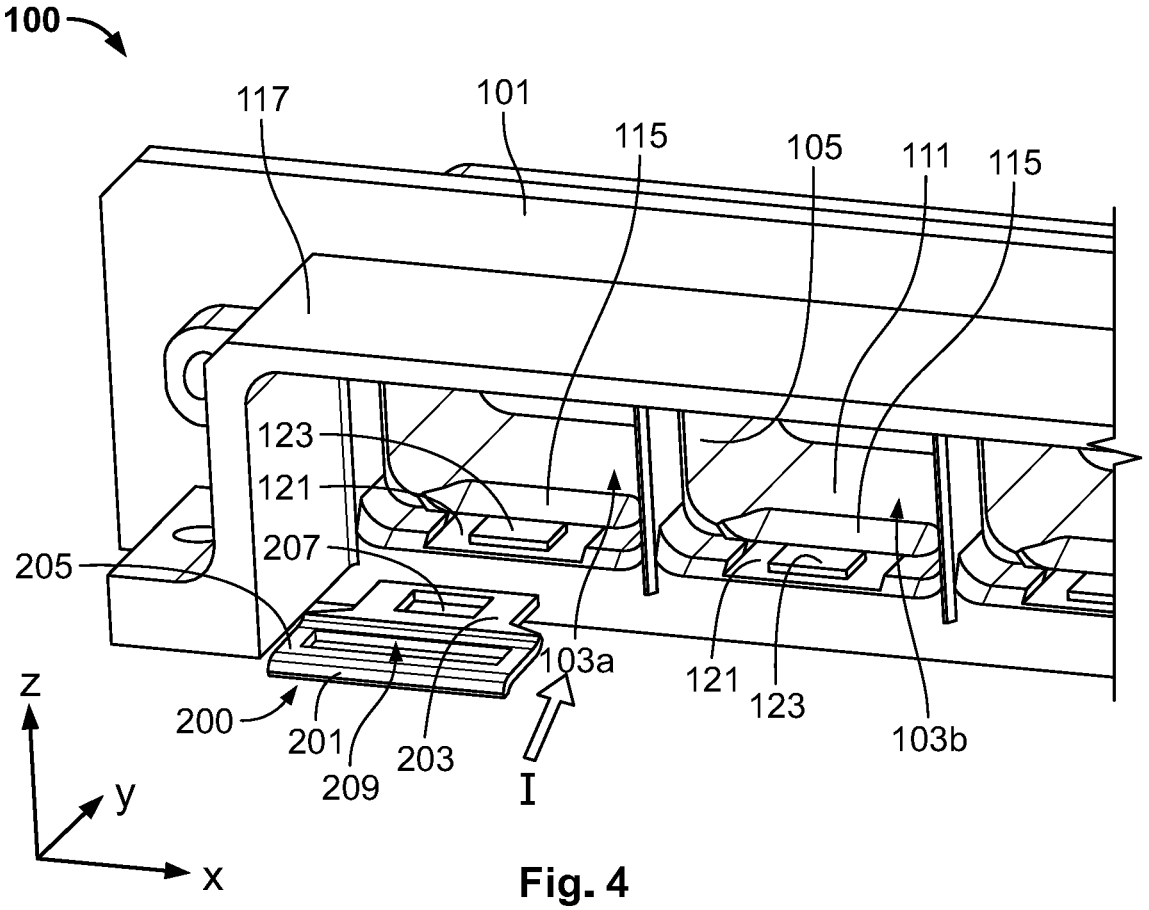
FIG. 4 is a perspective view of a portion of a modular electrical plug connector system according to the embodiments of FIG. 3 and FIGS. 1 and 2.
Figure 5:
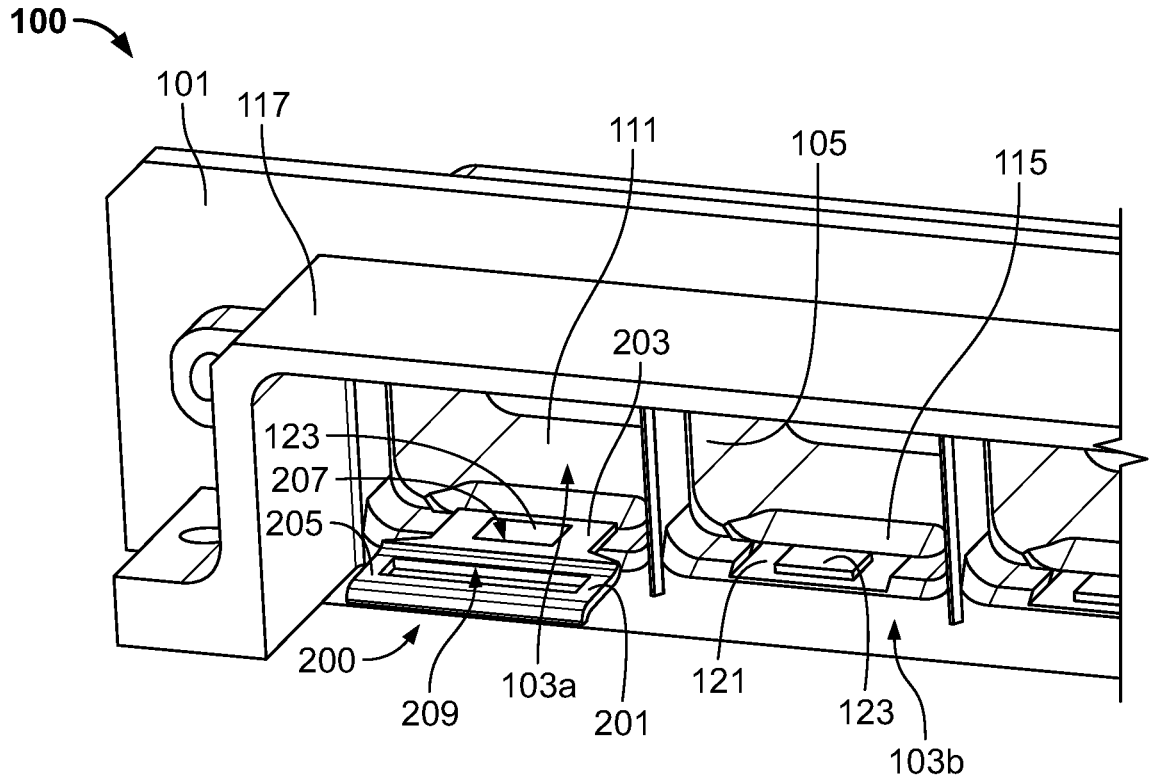
FIG. 5 is another perspective view of the modular electrical plug connector system of FIG. 4.

As shown in FIGS. 4 and 5, the connector interface engaging portion 203 is designed to fit in a recessed adapter receiving portion 121 and comprises a connector interface locking slot 207, which is arranged and configured for engaging a corresponding adapter locking tab 123 of any one of the module receiving passages 103 (103*a*-103*e*).

Furthermore, the module supporting portion 205 comprises a lower standard module locking slot 209 for engaging the lower locking tab 407 of a standard module 400 inserted in a module receiving passage 103, as shown in FIG. 8. In addition, in order to provide better support for the standard module 400, the module supporting portion 205 can be shaped in accordance with the standard module 400 and, for instance, comprise at least one slanted portion 211 between the connector interface engaging portion 203 and the module supporting portion 205. Optionally, in order to more easily manipulate the adapter 200, the module supporting portion 205 can end in another slanted portion 213. Additionally, depending on how much support and/or durability is needed, the adapter 200 can be made of metal or, alternatively, of a plastic material.

FIG. 4 shows, in particular, an embodiment of a modular electrical plug connector system according to an aspect of the present invention, in which the adapter 200 is about to be engaged with the adapter receiving interface of the module receiving passage 103*a*. In turn, as shown in FIG. 5, the modular electrical plug connector system with the adapter 200 is being mounted in the module receiving passage 103*a*. With the later configuration of the modular electrical plug connector system, the connector housing 100, which is configured for accommodating and locking one or more LP modules 300, can now also be used for module configurations including one or more standard modules 400, as the adapter 200 is positioned to properly support and lock a standard module 400 in a module receiving passage 103 as further shown in FIGS. 6 and 8.

When a standard module 400 is accommodated in one of the module receiving passages 103, for instance in the module receiving passage 103*a*, as shown in FIG. 6, with the adapter 200 having been positioned therein in advance, as shown in FIG. 5, the portion of the standard module body 401 projecting out of the module receiving passage 103*a* is supported by the module supporting portion 205 of the adapter 200, as shown in FIG. 8. Additionally, as shown in FIG. 8, the upper locking tab 405 of the standard module 400 is engaged in the upper standard module locking groove 119, and the lower locking tab 407 is engaged in the lower standard module locking slot 209 of the adapter 200 positioned in the adapter receiving portion 121.

Further embodiments of aspects of the present invention will now be described with reference, in particular, to FIGS. 9 to 12.

Figure 9:
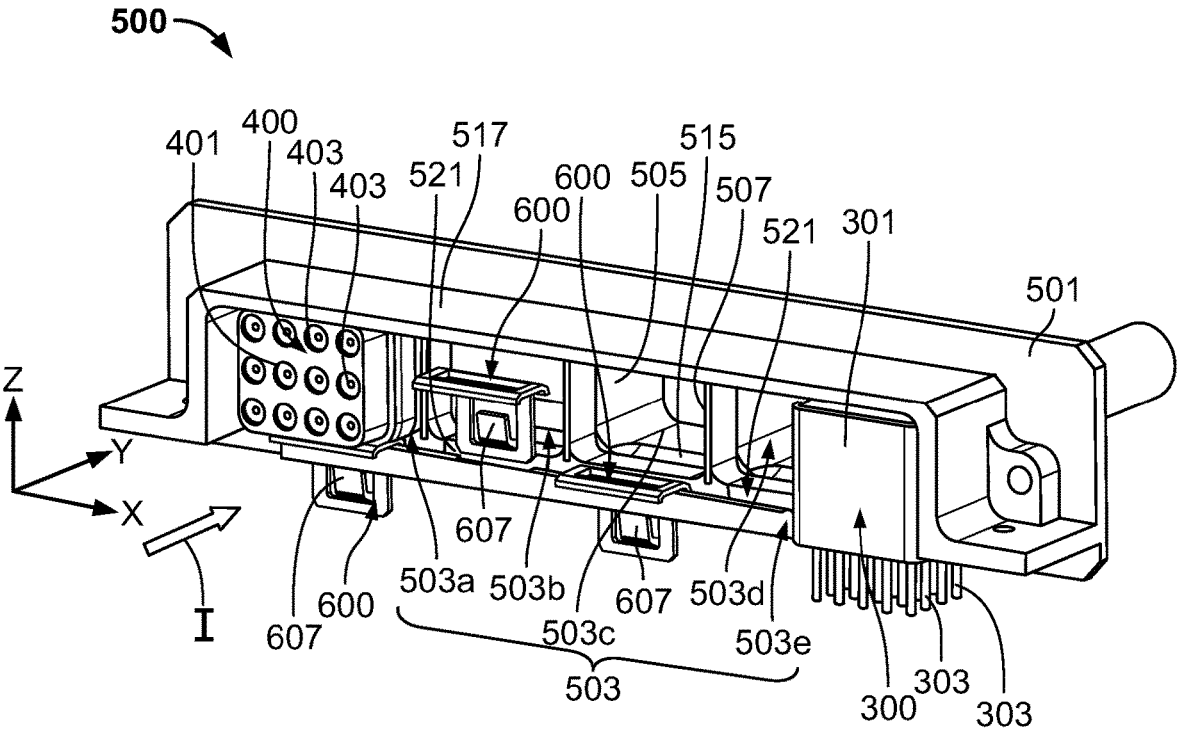
FIG. 9 is a perspective view of an embodiment of a modular electrical plug connector system of the invention.
Figure 11:
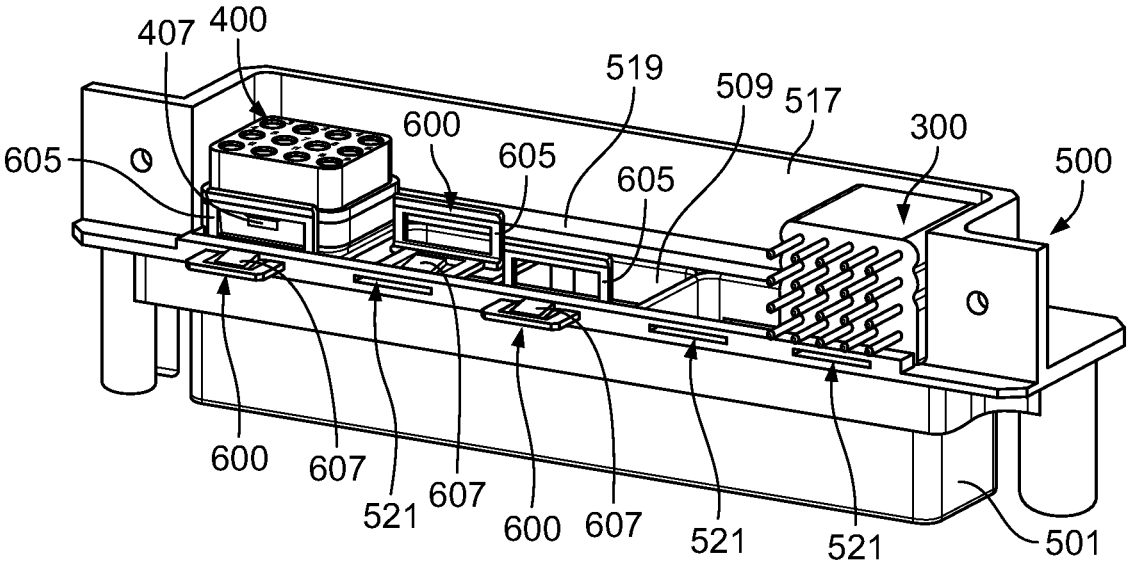
FIG. 11 is another perspective view of the modular electrical connector system of FIG. 9.

FIGS. 9 and 11 show an example of a modular electrical plug connector system according to an embodiment of the invention.

The connector system shown in FIGS. 9 and 11 comprises a connector housing 500 which, similar to the connector housing 100 discussed above, has a connector body 501 configured to receive, accommodate, and lock (in a removable manner), a plurality of plug-in connector modules of a first predetermined type. The connector housing 500 shares similar features and functions to the connector housing 100 described above a variation. As shown in FIGS. 9 and 11, similar to the connector housing 100 described above, the connector housing 500 is also configured to accommodate and lock, without any additional structural element, one or more LP modules 300. One of skill in the art would appreciate that a default configuration of a connector housing according to an aspect of the present invention could be adapted to accommodate a different type of plug-in connector module.

Figure 10:
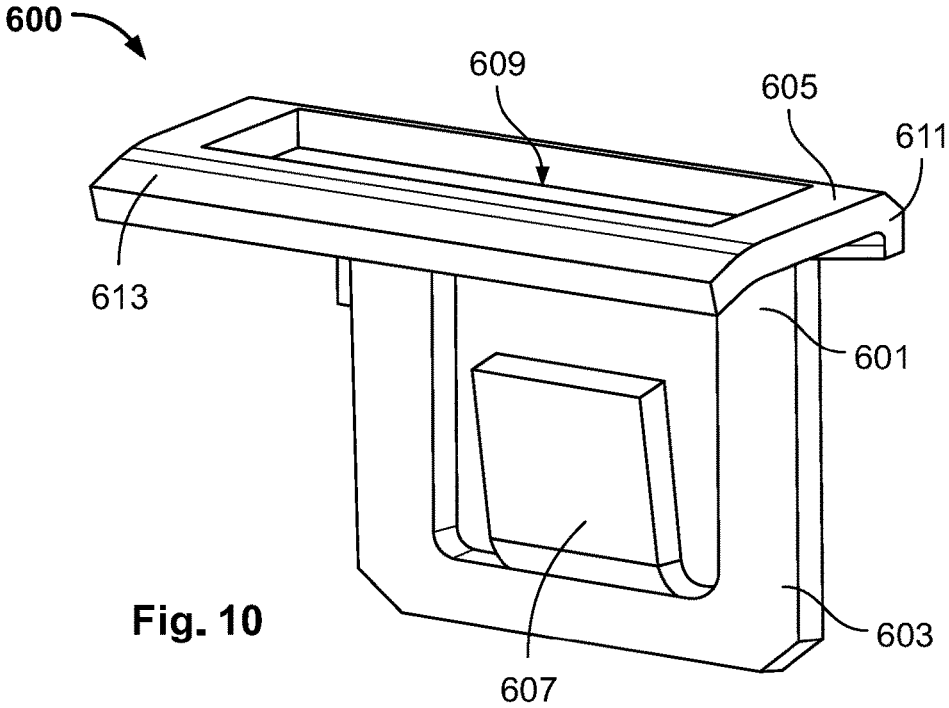
FIG. 10 is a perspective view of an embodiment of an adapter of the invention.
Figure 12:
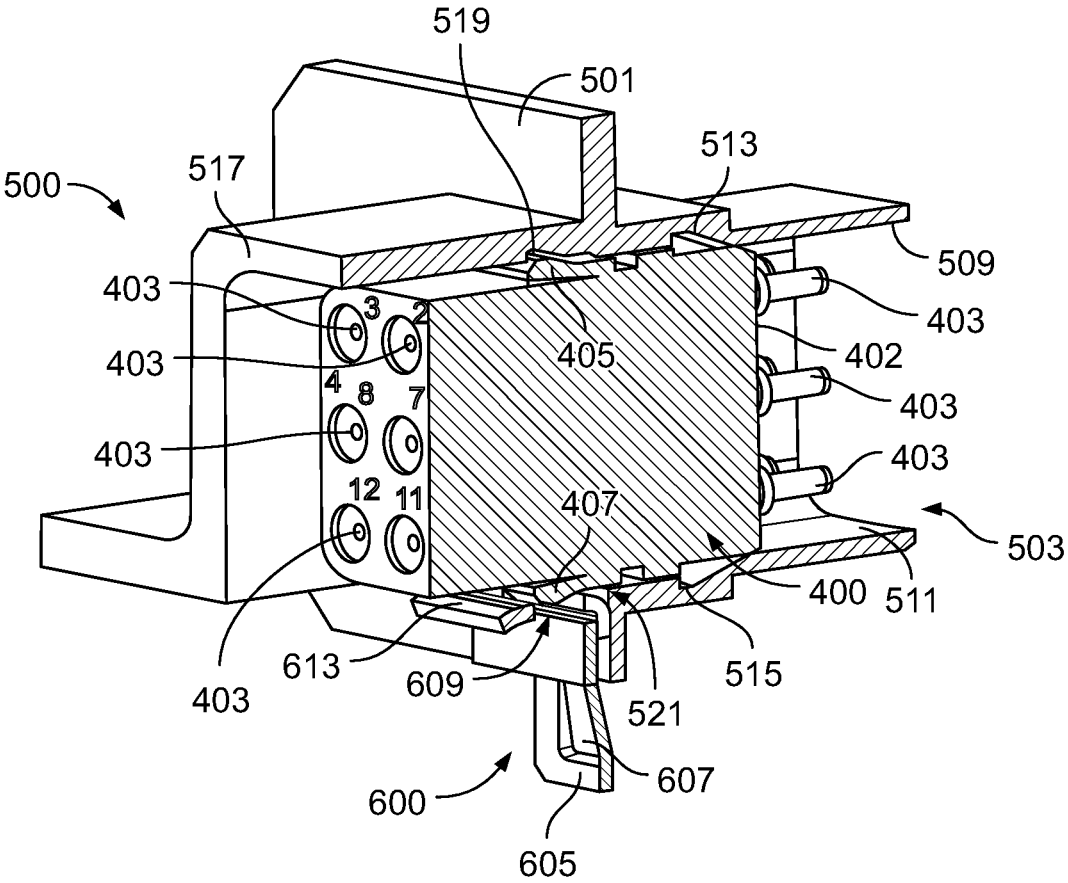
FIG. 12 is a sectional view of the modular electrical plug connector system of FIG. 9.

With reference to FIG. 12, when the connector housing 500 is used in combination with a removable adapter such as an adapter 600 shown in FIG. 10, the connector housing 500 can also accommodate and lock a standard module such as the standard module 400 described above.

As shown in FIGS. 9 and 11, the connector housing 500 comprises a connector body 501, a plurality of module receiving passages 503 (503*a*, 503*b*, 503*c*, 503*d*, 503*e*) having side walls 505, 507, upper and bottom walls 509, 511, upper and lower LP module locking grooves 513, 515, as well as a front protruding portion 517 provided with an upper standard module locking groove 519. These features are similar to the connector housing 100 of the embodiments described above.

Additionally, the shape and size of each module receiving passage 503 (503*a*-503*e*) is adaptable to accommodate and lock therein a corresponding LP connector module 300 without requiring an additional structural element such as an adapter. In the shown embodiments, in FIGS. 9 and 11, the connector housing 500 is shown with an LP connector module 300 accommodated and locked, in particular, in the module receiving passage 503*e*. Thus, in the module receiving passage 503*e*, the upper and lower LP module locking grooves 513, 515 are engaged and locked with the locking tab 305 and the locking lance 307 of the LP connector module 300, as described above and shown in FIG. 7. One of ordinary skill in the art would understand that the LP connector module 300 can be accommodated and locked in any one of the other module receiving passages 503*a*-503*d* in the same manner, i.e. without using an additional structural element. Furthermore, as described above, although the shown connector housing 500 can accommodate up to five LP connector modules 300, other embodiments and/or variations of a connector housing, according to an aspect of the present invention can comprise more or less that five passages and, therefore, can accommodate more or less plug-in connector modules accordingly.

In the embodiments shown in FIGS. 9 to 12, it is desirable to accommodate and lock a plug-in connector module of a different type than the LP module 300 in the connector housing 500 in an interchangeable manner with the LP modules. In particular, it is desirable to provide a solution for accommodating a standard module such as the standard module 400 described above.

Thus, in the embodiments, as described above, in order to prepare the connector housing 500 for accommodating and locking one or more standard modules 400, the front protruding portion 517 is positioned, at an inner surface thereof, with a locking groove arranged and configured for engaging a corresponding (upper) locking element of a standard module 400. Therefore, similar to the embodiments shown in FIGS. 11 and 12, the upper standard module locking groove 519 of the front protruding portion 517 of the connector housing 500 can be arranged and configured for engaging the upper locking tab 405 of a standard module 400.

Similarly to the above description in order to prepare the connector housing 500 for accommodating and locking a standard module 400, the connector housing 500 comprises an adapter receiving interface which is arranged and configured so as to receive, in a removable manner, an adapter for supporting the standard module 400 in at least one of the module receiving passages 503 and, in combination with the upper standard module locking groove 519, locking the standard module 400 in the module receiving passage 503. Likewise, as described above, and as shown, in FIG. 11, a corresponding adapter receiving interface can be provided in each module receiving passage 503 (503*a*-503*e*) for maximum modularity. Although each adapter receiving interface is also positioned towards the front opening of a corresponding module receiving passage 503, in the shown embodiments of FIGS. 9, 11, and 12, the adapter receiving interface is an adapter receiving slot 521 in the bottom wall 511 of the module receiving passage 503 in the connector housing 500.

FIG. 10 shows, an embodiment of an adapter 600 for supporting and locking an electrical connector module in the connector housing of a modular electrical plug connector system. As shown in FIGS. 9, 11, and 12, the adapter 600 is configured to engage the adapter receiving slot 521 of a module receiving passage 503 of the connector housing 500.

Thus, as shown in FIG. 10, and the associated embodiments, the adapter 600 comprises an adapter body 601 with a first end portion defining a connector interface engaging portion 603, which is a portion thereof arranged and configured for engaging the adapter receiving interface, i.e. here the adapter receiving slot 521, of any one of the module receiving passages 503 (503*a*-503*e*) of the connector housing 500. Additionally, the adapter body 601 comprises a second end portion defining a module supporting portion 605, which is a portion arranged and configured for supporting and locking a standard module 400 when used in combination with the connector housing 500. In these embodiments, the connector interface engaging portion 603 and the module supporting portion 605 can extend essentially perpendicular to one another. As a result, when the adapter 600 is mounted in the connector housing 500, the module supporting portion 605 extends along the insertion direction (I) (or the depth direction Y), and the connector interface engaging portion 603 extends downward along the height direction Z (see FIG. 9).

Further, as shown in FIGS. 9, 11, and 12, the connector interface engaging portion 603 of the adapter 600 is designed to be inserted in any one of the adapter receiving slots 521 and locked with the same. Accordingly, as shown in more detail in FIG. 10, the connector interface engaging portion 603 comprises a resiliently deflectable connector interface locking tab 607 (or locking lance), which is arranged and configured for returning to its initial position once the connector interface engaging portion 603 has been properly inserted through the adapter receiving slot 521 of a module receiving passage 503 so as to lock.

In a similar manner to the adapter 200 described above, the module supporting portion 605 of the adapter 600 comprises a lower standard module locking slot 609 for engaging the lower locking tab 407 of a standard module 400 inserted in a module receiving passage 503, as shown in FIGS. 10 and 12. As a result, when a standard module 400 is accommodated in one of the module receiving passages 503, for instance in the module receiving passage 503*a* as shown in FIGS. 9 and 11, with the adapter 600 having been positioned therein in advance, the portion of the standard module body 401 projecting out of the module receiving passage 503*a* is supported by the module supporting portion 605 of the adapter 600, as can be seen, in FIG. 11. Additionally as shown in FIG. 12, the upper locking tab 405 of the standard module 400 is engaged in the upper standard module locking groove 519, and the lower locking tab 407 is engaged in the lower standard module locking slot 609 of the adapter 600 inserted in the adapter receiving slot 521.

As described above with respect to the adapter 200, in order to provide better support for the standard module 400, the module supporting portion 605 can be shaped in accordance with the standard module 400 and, for instance, comprise at least one slanted portion 611 between the connector interface engaging portion 603 and the module supporting portion 605. Optionally, in order to more easily manipulate the adapter 600, the module supporting portion 605 can also end in another slanted portion 613. Furthermore, depending on how much support and/or durability is needed, the adapter 600 can be made of metal or, alternatively, of a plastic material.

FIGS. 9 and 11 show an embodiment of a modular electrical plug connector system having a standard module 400 accommodated and locked in the module receiving passage 503*a* by an adapter 600 inserted in the corresponding adapter receiving slot 521, while a LP module 300 is accommodated and locked in the module receiving passage 503*e*. FIGS. 9 and 11 also show a second adapter 600 about to be inserted in the adapter receiving slot 521 of the module receiving passage 503*b*, and a third adapter 600 inserted in the corresponding adapter receiving slot 521 of the module receiving passage 503*c*. In the shown configuration, another standard module 400 could be accommodated and locked, for instance, in the module receiving passage 503*c* and potentially also in the module receiving passage 503*b*, while the module receiving passage 503*d* is left free and, therefore, could receive another LP module 300 (or another standard module 400 with a corresponding adapter 600).

Further embodiments of aspects of the present invention will now be described, in particular, with reference, in particular, to FIGS. 13 to 17.

Figure 13:
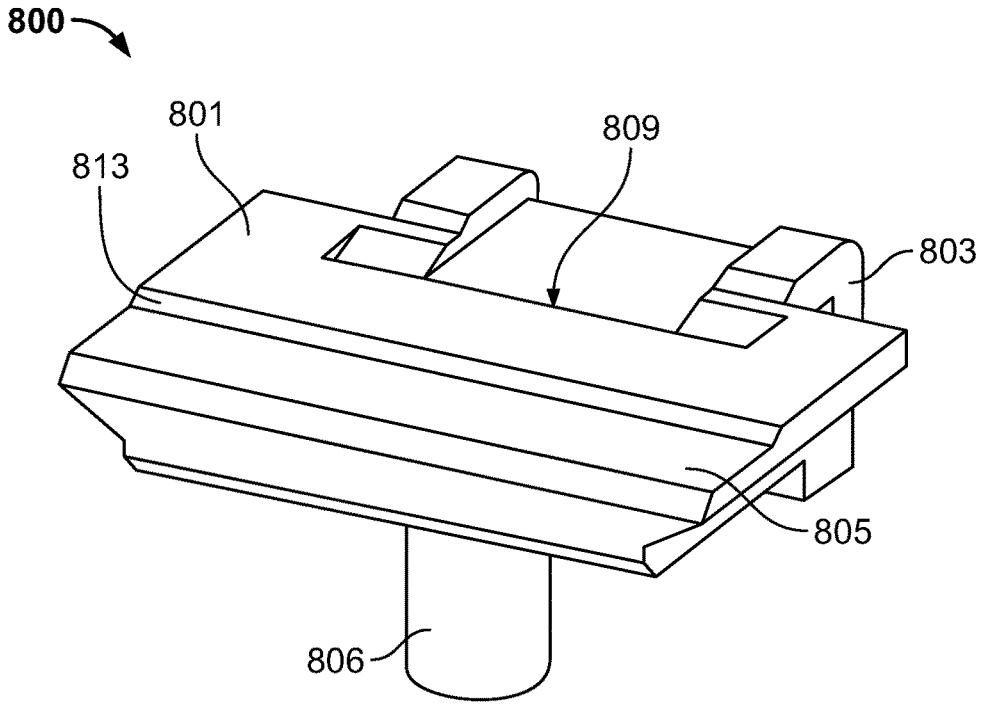
FIG. 13 is a perspective view of an adapter according to the invention.
Figure 14:
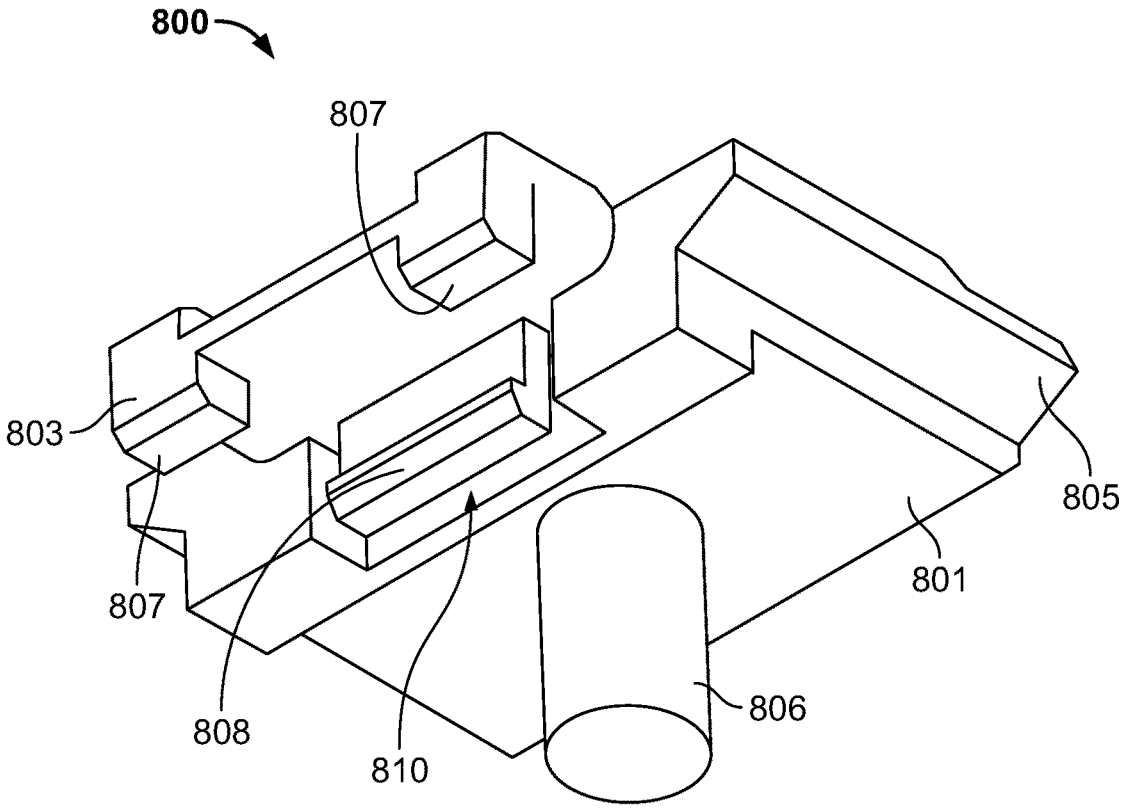
FIG. 14 is another perspective view of the adapter FIG. 13.

FIGS. 13 and 14 show an embodiment of an adapter 800 for supporting and locking an electrical connector module in the connector housing of a modular electrical plug connector system, according to the present invention. The adapter 800 is configured for engaging the adapter receiving interface in a module receiving passage in a modular electrical plug connector system. Thus, in some embodiments, the adapter 800 can be configured for engaging the adapter receiving interface, i.e. the adapter receiving groove 721 of the connector housing describing the previous embodiments, thus it could also be referred to as an adapter receiving slot. In the embodiments shown in FIGS. 16 and 17, the adapter 800 is configured for engaging, in particular, the adapter receiving interface of a module receiving passage 703 of a connector housing 700 according to an embodiment of the invention.

Figure 16:
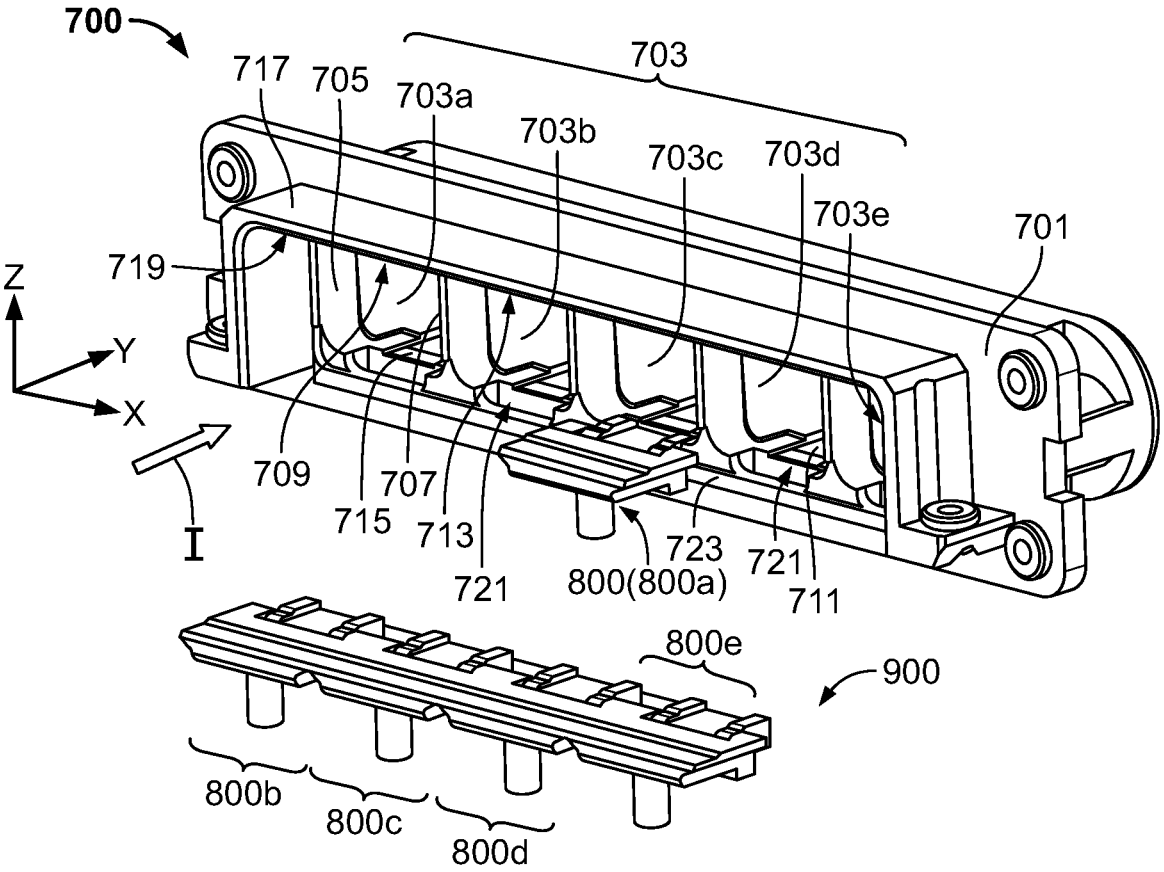
FIG. 16 is a perspective view of a modular electrical plug connector system of the invention, in which an adapter according to the embodiment illustrated in FIGS. 13 and 14 and/or an adapter strip according to the embodiment illustrated in FIG. 15 is/are used.
Figure 17:
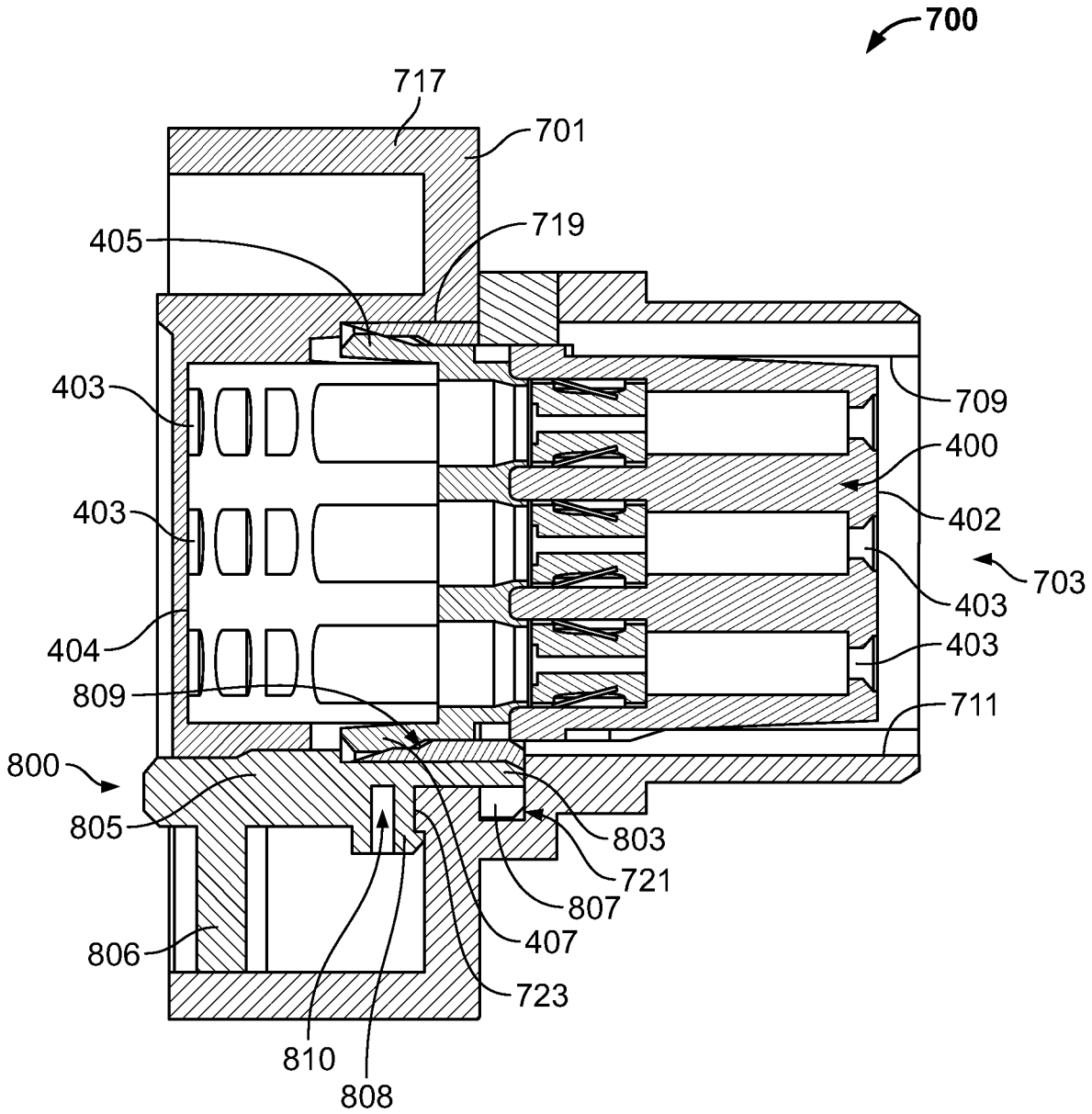
FIG. 17 is a cross-sectional side view of an exemplary embodiment of a modular electrical plug connector system of the invention of FIGS. 13, 14, 15 and FIG. 16.

As shown in FIGS. 13 and 14, the adapter 800 comprises an adapter body 801 with a first end portion defining a connector interface engaging portion 803, and is a portion arranged and configured for engaging the adapter receiving interface of a connector housing and, in particular the adapter receiving interface of any one of the module receiving passages 703 (703*a*-703*e*) of the connector housing 700 as shown in FIGS. 16 and 17. Additionally, the adapter body 801 comprises a second end portion defining a module supporting portion 805, which is a portion arranged and configured to support and lock a predetermined type of plug-in connector module that could otherwise not be properly accommodated and locked in a module receiving passage 703 of the connector housing 700. As shown in FIG. 17, similar to described above, the adapter 800 is used for supporting and locking a standard module 400 in a module receiving passage 703 of the connector housing 700.

In this embodiment, the connector interface engaging portion 803 can be in a prolongation of the module supporting portion 805, with the latter extending essentially along the insertion direction (I) (or the depth direction Y) when the adapter 800 is mounted in a module receiving passage 703 of the connector housing 700 as shown in FIGS. 16 and 17.

Furthermore, as shown in FIG. 14, instead of the connector interface locking slot 207 and the deflectable connector interface locking tabs 607, as described above, here the connector interface engaging portion 803 of the adapter 800 can comprise two fixed connector interface locking tabs 807 which protrude downwards from the end portion of the connector interface engaging portion 803, and a resiliently deflectable connector housing locking lance 808 which can also protrude downwards (along the direction Z in the orientation shown, e.g., in FIG. 16), facing the connector interface locking tabs 807. In addition, at the interface between the connector interface engaging portion 803 and the module supporting portion 805, the adapter 800 can further comprise a locking lance deflection space 810 as shown in FIGS. 14 and 17, configured and arranged for allowing deflection of the connector housing locking lance 808.

In addition, instead of the lower standard module locking slots 209, 609 of the previous embodiments, in this embodiment, the module supporting portion 805 of the adapter 800 comprises a lower standard module locking groove 809, which is arranged and configured for engaging the lower locking tab 407 of a standard module 400 inserted in a module receiving passage 703 of the connector housing 700 as shown in FIG. 17. As shown in FIG. 13, the lower standard module locking groove 809 is provided as a recess of the upper surface of the module supporting portion 805.

In a similar manner to the slanted portions 213, 613 described above with respect to the adapters 200, 600, here in order to provide better support for a standard module 400, the surface of the module supporting portion 805 of the adapter 800 of this embodiment can be shaped with a stepped portion 813, as shown in FIG. 13. Additionally, in order to provide an even better support for a standard module 400, and in order to even more easily manipulate the adapter 800, the adapter body 801 can further comprise a supporting member 806 protruding downwards from the module supporting portion 805. In the shown embodiment, the supporting member 806 is a cylinder-shaped foot which can provide improved support by resting on a PCB to which the connector housing 700 could be attached. It is understood, however, that the supporting member 806 could have a variety of other shapes or alternate embodiments without departing from the present invention.

As also described in relation to the adapters 200, 600 described above, the adapter 800 of this embodiment could be made of metal or of a plastic material. However, in comparison to the adapters 200, 600, since the adapter 800 provides even more support for a standard module 400 accommodated in the locked in a module receiving passage 703 of the connector housing 700, a plastic material is preferred, as it reduces the production cost of the adapter 800. Indeed, known molding processes could be used for manufacturing the adapter 800.

Figure 15:
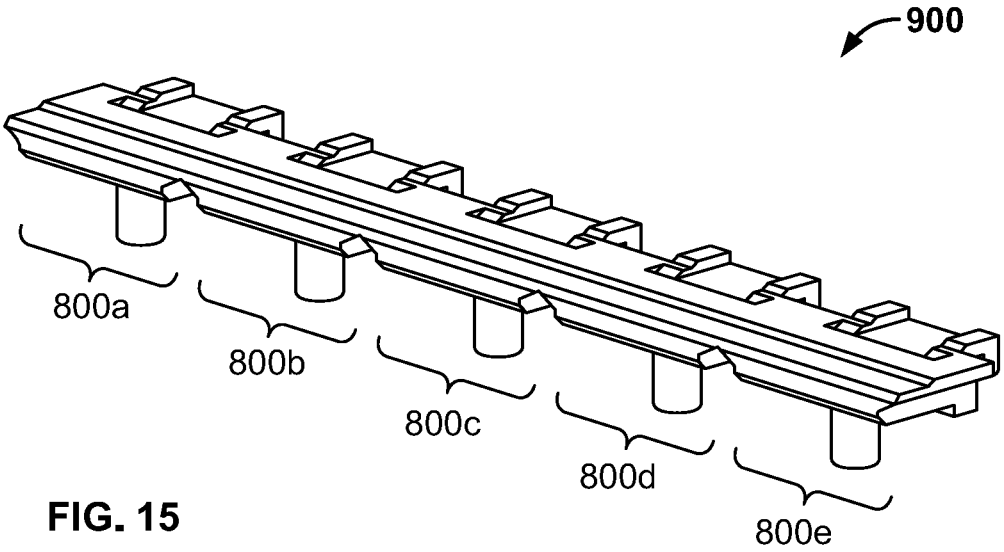
FIG. 15 is a perspective view of an adapter strip of the invention.

Furthermore, it would be possible to provide one of the adapters described above by manufacturing an adapter strip consisting of a side-by-side arrangement of a plurality of adapters according to an aspect of the present invention. For instance, FIG. 15 shows an embodiment of an adapter strip 900, which consists of a side-by-side arrangement of a plurality of adapters 800 (800*a*, 800*b*, 800*c*, 800*d*, 800*e*). When using plastic materials, the adapter strip 900 can be made by known molding processes which would reduce the production costs compared to adapters made of metal. In any event, this would reduce production costs with respect to known modular electrical plug connector systems which need to design a specific bottom plate for the connector housing every time that a plug-in connector module configuration is changed.

In particular, the adapter strip 900 can be molded as an integral piece, with a plurality of adapters 800 joined to one another. For instance, one adapter strip 900 could be formed of at least as many adapters 800 as the number of module receiving passages 703 in a connector housing 700. In these embodiments, since the connector housing 700 comprises five module receiving passages 703 (703*a*-703*e*), in particular like the connector housings 100, 500 of the previous embodiments, the adapter strip 900 illustrated in FIG. 15 is formed of five adapters 800 (800*a*-800*e*). One of ordinary skill in the art would appreciate that an adapter strip could consist of more or less than five adapters without departing from the scope of the present invention.

FIG. 16 shows a modular electrical plug connector system according to an embodiment of the present invention. The connector system comprises a connector housing 700 which, similar to the connector housings 100, 500 described above, has a connector body 701 configured to receive, accommodate, and lock (in a removable manner), a plurality of plug-in connector modules of a first predetermined type. The connector housing 700 shares similar features and functions described above in respect to the connector housings 100, 500. Thus, for the sake of simplicity, the connector housing 700 of this embodiment is also configured for accommodating and locking, by default (i.e., without any additional structural element), one or more LP modules 300 using similar features described above. As noted above, in other embodiments, a connector housing can be adapted to accommodate a different type of plug-in connector module.

As shown in FIG. 17, when the connector housing 700 is used in combination with a removable adapter such as the adapter 800 shown in FIGS. 13 and 14, and/or with the adapter strip 900 described with reference to FIG. 15, the connector housing 700 can also accommodate and lock standard module such as the standard module 400 described above.

As shown in FIG. 16, the connector housing 700 comprises a connector body 701, a plurality of module receiving passages 703 (703*a*, 703*b*, 703*c*, 703*d*, 703*e*) having side walls 705, 707, upper and bottom walls 709, 711, upper and lower LP module locking grooves 713, 715, as well as a front protruding portion 717 provided with an upper standard module locking groove 719. One of ordinary skill in the art would appreciate from the disclosure that these features correspond to the features described above for the connector housings 100, 500, namely the connector bodies 101, 501, the module receiving passages 103, 503 (including sidewalls 105, 107 and 505, 507, upper and bottom walls 109, 111 and 509, 511, upper and lower LP module locking grooves 113, 115 and 513, 515), and the respective front protruding portion 117, 517 provided with a upper standard module locking groove 119, 519.

As described above an LP connector module 300 can be accommodated and locked in any one of the module receiving passages 703 (703*a*-703*e*) without any additional structural element such as an adapter. That being said, when an LP module 300 is accommodated and locked in one module receiving passages 703, the upper and lower LP module locking grooves 713, 715 would be engaged and locked with the locking tab 305 and the locking lance 307 of the LP connector module 300, as described above, in particular, with reference to FIG. 7. In any case, the shown connector housing 700 can accommodate up to five LP connector modules 300, other embodiments and/or alternatives of a connector housing according to an aspect of the invention can comprise more or less than five passages and, therefore, can accommodate more or less plug-in connector modules.

As shown in FIGS. 16 and 17, it is desirable to accommodate and lock a plug-in connector module of a different type than the LP module 300 in the connector housing 700 in an interchangeable manner with the LP modules. In particular, it is desirable to provide a solution for accommodating a standard module such as the standard module 400 described in the previous embodiment.

Accordingly, the front protruding portion 717 of the connector housing 700 of the embodiment shown in FIGS. 16 and 17 can also be provided, at an inner surface, with the locking groove arranged and configured for engaging the corresponding (upper) locking element of a standard module 400. In particular, similar to other embodiments and as shown in FIG. 17, an upper standard module locking groove 719 is provided in the front protruding portion 717 of the connector housing 700 and is arranged and configured for engaging the upper locking tab 405 of a standard module 400.

Similar to other embodiments, in order to prepare the connector housing 700 for accommodating and locking a standard module 400, the connector housing 700 comprises an adapter receiving interface which is arranged and configured so as to receive, in a removable manner, an adapter for supporting the standard module 400 in at least one of the module receiving passages 703 and, in combination with the upper standard module locking groove 719, locking the standard module 400 in the module receiving passage 703. Likewise, as can be seen, in FIG. 16, a corresponding adapter receiving interface can be provided for maximum modularity, preferably, in each module receiving passage 703 (703*a*-703*e*). In this embodiment, similar to others, each adapter receiving interface is positioned preferably towards the front opening of a corresponding module receiving passage 703. However, as shown in FIGS. 16 and 17, in the connector housing 700, the adapter receiving interface is provided as an adapter receiving groove 721 in the bottom wall 711 of each module receiving passage 703, and further comprises an adapter locking lip 723 protruding from the front side of the connector body 701, below the bottom wall 711 of each module receiving passage 703.

Additionally, FIG. 16 shows the connector housing 700 and the adapter strip 900 according to an embodiment. In this embodiment, the adapter strip 900 is formed from five adapters 800 (800*a*-800*e*), which are joined to each other in a cleavable or severable manner. Thus, one adapter 800*a* is separated from the adapter strip 900 and can now be attached to an adapter receiving interface over module receiving passage 703 of the connector housing 700 in order to provide support and locking functionality for a standard module 400, as shown in FIG. 17. In the illustrated embodiment, an adapter 800 (800*a*) is positioned in front of the module receiving passage 703*c*, and the adapter strip 900, therefore, further comprises the remaining four adapters 800*b*-800*e*.

It should be noted that an adapter strip such as the adapter strip 900, formed by as many adapters 800 as required, could be used directly, without being cleaved, in order to achieve a configuration with multiple standard modules 400 at once. Thus, in other embodiments, adapter strips comprising any required number of adapters 800 joined side-by-side could be attached directly to several module receiving passages 703 at the same time.

As mentioned above, FIG. 17 shows an embodiment in which a standard module 400 is accommodated and locked in a module receiving passage 703 by an adapter 800 engaged with a corresponding adapter receiving interface. Thus, the connector interface locking tabs 807 are engaged in the adapter receiving groove 721 of the bottom wall 711 of the module receiving passage 703. Furthermore, the connector housing locking lance 808, which can be deflected in the locking lance deflection space 810 during the mounting process, is now locked with the adapter locking lip 723 at the front side of the connector body 701. Moreover, in a similar manner to what was described above, the upper locking tab 405 of the standard module 400 is engaged in the upper standard module locking groove 719, and the lower locking tab 407 is engaged in the lower standard module locking groove 809 of the adapter 800.

In addition, the supporting member 806 provides improved mechanical support for the standard module 400 with respect to the adapters 200, 600 of the other embodiments as shown in FIGS. 8 and 12. Furthermore, with the supporting member 806, the manipulation and, therefore, mounting of the adapter 800 on an adapter receiving interface of the connector housing 700 is facilitated, in particular, with respect to the adapters 200, 600.

As in described above with reference to FIGS. 1 through 8, FIGS. 9 through 12, and in FIGS. 13 through 17, it is possible to change configurations comprising LP modules 300 and standard modules 400 without effort and without having to design or redesign an expensive specific bottom plate for the body of the connector housings 100, 500, 700 for each configuration.

Indeed, the present invention provides a connector housing of a modular electrical plug connector system (e.g., one of the connector housings 100, 500, 700), which can be manufactured in a standard and simple manner (e.g., by molding) and wherein a first predetermined type of plug-in connector module (e.g., an LP module 300) can be accommodated and locked by default. When a second, different, predetermined type of plug-in connector module needs to be used (e.g., a standard module 400), another aspect of the present invention provides an adapter (e.g. one of the adapters 200, 600, 800) which can be received in adapter receiving interface of a connector housing according to the former aspect of the invention in order to support and lock said second predetermined type of plug-in connector module.

Depending on the level of support and/or on the desired ease of manipulation, an adapter according to the latter aspect of the invention could be made of metal or of a plastic material. Additionally an adapter strip (e.g., adapter strip 900), facilitates and improves the standardizing of the production of some alternative embodiments of the adapter.

What is claimed is:

1. A connector housing of a modular electrical plug connector system, comprising:

a plurality of substantially identical passages arranged side by side, each passage configured to accommodate and directly engage with a body of an electrical connector module of a first predetermined type for locking the electrical connector of the first predetermined type within the passage, and at least one passage of the plurality of passages comprises:

a first locking feature for engaging with a corresponding first feature of the electrical connector module of the first predetermined type;

a second locking feature for engaging with a corresponding second feature of the electrical connector module of the first predetermined type; and an adapter receiving interface configured to removably receive an adapter for supporting and locking an electrical connector module of a second predetermined type, different from the first predetermined type, the adapter receiving interface including an adapter locking feature for engaging with the adapter for securing the adapter within the passage, the adapter locking feature distinct from the first and second locking features.

2. The connector housing of a modular electrical plug connector system according to claim 1, wherein the passages are arranged side by side along a first direction (X) and extend along a second direction (Y) being an insertion direction (I) substantially perpendicular to the first direction (X).

3. The connector housing of a modular electrical plug connector system according to claim 1, further comprising a locking groove configured for engaging a respective locking element of an electrical connector module of the second predetermined type, and the adapter receiving interface arranged opposite the locking groove along a third direction (Z) substantially perpendicular to the first and second directions (X, Y).

4. The connector housing of a modular electrical plug connector system of claim 1, wherein the adapter receiving interface has a locking tab, a slot, and a groove, or a combination thereof.

5. The connector housing of a modular electrical plug connector system according to claim 1, wherein the adapter has a first portion configured for engaging, in a removable manner, an adapter receiving interface of a connector housing in a particular passage.

6. The connector housing of a modular electrical plug connector system according to claim 1, wherein the adapter has a second portion configured for supporting and locking an electrical connector module accommodated in a passage.

7. The connector housing of a modular electrical plug connector system according to claim 5, wherein the first portion has at least one of a slot, a locking tab, and a locking lance, or a combination thereof.

8. The connector housing of a modular electrical plug connector system according to claim 6, wherein the second portion has at least one of a groove, and a slot, or a combination thereof.

9. The connector housing of a modular electrical plug connector system according to claim 5, wherein the first portion is substantially perpendicular to said second portion.

10. The connector housing of a modular electrical plug connector system according to claim 6, wherein the second portion is at least one of slanted or stepped.

11. The connector housing of a modular electrical plug connector system according to claim 6, wherein the second portion has a protrusion forming a supporting member extending from said second portion.

12. The connector housing of a modular electrical plug connector system according to claim 11, wherein the supporting member extends from said second portion in a substantially perpendicular manner.

13. The connector housing of a modular electrical plug connector system according to claim 1, having an adapter strip consisting of a side-by-side arrangement of a plurality of adapters that are joined to each other.

14. The connector housing of a modular electrical plug connector system according to claim 1, wherein the electrical connector module of the first predetermined type is locked within the passage via engagement with the first and second locking features.

15. The connector housing of a modular electrical plug connector system according to claim 1, wherein the passage further defines a third locking feature, wherein the electrical connector module of the second predetermined type is locked within the passage via engagement with the third locking feature and a connector module locking feature defined by the adapter when the adapter is secured within the passage.

16. The connector housing of a modular electrical plug connector system according to claim 15, wherein:

the first locking feature comprises a first locking groove formed in a first side of the passage;

the second locking feature comprises a second locking groove formed in a second side of the passage; and the adapter locking feature comprises at least one of a recess or a locking tab for engaging with the adapter.

17. The connector housing of a modular electrical plug connector system according to claim 16, wherein the third locking feature comprises a third locking groove.

18. A connector housing assembly of a modular electrical plug connector system, comprising:

a housing defining a passage formed therein, the housing including at least one first locking feature for engaging with an at least one complementary locking feature of an electrical connector module of a first predetermined type arranged within the passage, and at least one second locking feature for engaging with a complementary locking feature of an electrical connector module of a second predetermined type arranged within the passage; and an adapter configured to be removably connected to the housing and defining a connector module locking feature, wherein, when arranged within the passage, the electrical connector module of the second predetermined type engages with the at least one second locking feature of the housing and the connector module locking feature of the adapter.

19. The connector housing of a modular electrical plug connector system according to claim 18, wherein the at least one first locking feature comprises a first locking feature formed in a first side of the passage and a second locking feature formed in a second side of the passage.

* * * * *